US007156222B2

(12) United States Patent
Schnuelle et al.

(10) Patent No.: US 7,156,222 B2
(45) Date of Patent: Jan. 2, 2007

(54) MAGAZINE APPARATUS FOR RETAINING FLEXIBLE BAGS

(75) Inventors: Stephen D. Schnuelle, Appleton, WI (US); Richard Stapp, Brentwood, CA (US); Glenn Hayes, Hayward, CA (US)

(73) Assignee: Campbell Wrapper Corporation, DePerre, WI (US)

( * ) Notice: Subject to any disclaimer, the term of this patent is extended or adjusted under 35 U.S.C. 154(b) by 94 days.

(21) Appl. No.: 10/967,032

(22) Filed: Oct. 15, 2004

(65) Prior Publication Data

US 2006/0087071 A1 Apr. 27, 2006

(51) Int. Cl.
*B65G 15/14* (2006.01)

(52) U.S. Cl. ..... 198/626.3; 198/626.5; 198/699.1

(58) Field of Classification Search ..... 198/626.1, 198/626.2, 626.3, 626.5, 699, 699.1; 414/798.2, 414/798.7

See application file for complete search history.

(56) References Cited

U.S. PATENT DOCUMENTS 2,374,429 A * 4/1945 Hayes et al. ..... 144/248
4,798,281 A * 1/1989 Egger ..... 198/698
5,368,643 A * 11/1994 Kuster ..... 118/324
5,492,216 A * 2/1996 McCoy et al. ..... 198/626.5
5,775,068 A * 7/1998 Strasser et al. ..... 53/550
5,823,318 A * 10/1998 Baur et al. ..... 198/699.1
6,634,487 B1 * 10/2003 Ritter et al. ..... 198/726
6,945,530 B1 * 9/2005 Cinotti et al. ..... 271/240

OTHER PUBLICATIONS

Prior art apparatus comprising left and right side bristle belts for retaining opposite lateral edges of bags retained in the apparatus; Figures 1-8; pp. 1-8; Pack Expo Show, Chicago, Illinois, Nov. 2002.

* cited by examiner

*Primary Examiner*—Patrick Mackey
*Assistant Examiner*—Mark A. Deuble
(74) *Attorney, Agent, or Firm*—Wood, Phillips, Katz, Clark & Mortimer

(57) ABSTRACT

A powered magazine apparatus for retaining and transporting flexible bags comprises a base conveyor, and a pair of first and second digitated conveyor belts positioned on respective opposite sides of the base conveyor. Each of the digitated conveyor belts comprises a large multiplicity of outwardly projecting fingers. Each of the bags to be retained and transported is supported at its lower extent by the base conveyor, while opposite marginal edges of each bag are supported substantially through their vertical extents by the projecting fingers of each of the first and second digitated belts.

11 Claims, 3 Drawing Sheets

MAGAZINE APPARATUS FOR RETAINING FLEXIBLE BAGS

TECHNICAL FIELD

The present invention relates generally to an apparatus for retaining and advancing flexible bags for presentation to an associated filling apparatus, and more particularly to a magazine apparatus for retaining flexible bags which comprises a base conveyor, and a pair of generally vertically oriented digitated conveyor belts, which cooperate with the base conveyor to retain and advance the flexible bags in a generally upright orientation.

BACKGROUND OF THE INVENTION

A wide variety of granulated or otherwise free-flow particulate products are packaged and sold in relatively large, flexible bags, including products such as bird seed, fertilizer, pet food, and the like. In order to promote efficient packaging of such products, automated weighing and dispensing machines are typically employed, with operation of such machines requiring that the flexible bags to be filled be presented to the machine in a generally upright orientation. Suitable opening and positioning mechanisms are subsequently employed for positioning and opening each bag in operative association with the associated dispensing apparatus, whereby the desired quantity of product is placed in each bag. Each bag is typically thereafter transported to an associated sealing apparatus or the like for closing the top of the now-filled package.

Heretofore, gravity-fed magazine-like devices have been employed for holding stacks of flexible bags, typically paper, with an endmost one of a bag in the magazine removed for subsequent filling. However, such magazine-like devices cannot always accommodate and efficiently handle, relatively large flexible bags, typically formed from paper or polymeric materials which can exhibit relatively slippery exterior surfaces. Additionally, because the flexible bags to be filled may be configured to include a bottom gusset, or other features such as a recloseable end or valve structure, making that end of the bag relatively thick, it is not unusual for a large stack of such bags to be "lopsided," in the sense that one end of the stack (at which the bottom gussets of the bags are positioned) is much thicker than the other.

Efforts have been made to develop magazine devices for retaining and horizontally transporting and presenting large flexible bags, with the bags maintained in a generally vertical orientation, for subsequent filling. One such apparatus has employed a base conveyor, and a pair of associated, vertically oriented conveyors each formed from a plurality of vertically spaced bristled belts. In such an arrangement, each bag is maintained in a generally vertical orientation on the base conveyor, with opposite lateral edges of each bag retained within the bristled belts of the pair of vertical conveyors. However, experience has shown that flexible bags, which ordinarily do not exhibit much rigidity, may not always be efficiently and consistently retained within the bristled belts of the vertical conveyors. Because each vertical conveyor includes a plurality of vertically spaced bristled belts, each bag is substantially unsupported along portions thereof extending between the vertically spaced bristled belts. The frequently slippery, and flexible nature of such bags can cause them to become folded or otherwise displaced from an upright, fully extended orientation during advancement by such a device, precluding proper presentation of the bag for subsequent filling.

The present invention is directed to an improved magazine apparatus for retaining and conveying flexible bags in a fully extended, generally upright orientation for subsequent filling such as by automated filling equipment.

SUMMARY OF THE INVENTION

A powered magazine apparatus for retaining flexible bags in accordance with the present invention includes a base indexing conveyor, and a pair of vertically oriented indexing conveyors on respective opposite sides of the base conveyor. Notably, the vertical conveyors each comprise a digitated conveyor belt, comprising a large multiplicity of outwardly projecting fingers spaced vertically and horizontally from each other. As the digitated belts, and the base conveyor, are independently operated and indexed, flexible bags are retained and advanced in an upright, generally fully extended orientation as they rest upon the base conveyor, with opposite lateral edges of each bag generally retained within and between the outwardly projecting fingers of the digitated conveyor belts. Independent operation of the conveyors efficiently and consistently horizontally advances and transports the flexible bags in a generally upright, fully extended orientation, for presentation to an associated filling apparatus.

In accordance with the illustrated embodiment, the present apparatus includes a base frame, with the base conveyor of the apparatus carried by the base frame. First and second, generally vertically oriented side frames are positioned on respective opposite sides of the base conveyor. The apparatus includes first and second digitated conveyor belts respectively carried by the first and second side frames. Each of the digitated belts comprises a large multiplicity of outwardly projecting fingers, spaced horizontally and vertically from each other. The digitated belts may be formed from suitable elastomeric materials, whereby the fingers of each belt which may be generally conic, and exhibit sufficient resilient flexibility and friction to efficiently cooperate with the associated flexible bags to be retained by the apparatus.

Each of the digitated belts of the present apparatus defines an inner run along which the fingers of each digitated belt extend inwardly toward the base conveyor. By this arrangement, each flexible bag to be retained and conveyed is supported at its lower extent by the base conveyor, with opposite marginal portions of each bag supported substantially throughout the vertical extent thereof by the projecting fingers of the first and second digitated belts.

In order to readily accommodate bags of varying dimensions, the present magazine apparatus preferably includes a vertical adjustment mechanism for selectively vertically adjusting the position of the base conveyor between the first and second digitated conveyor belts. A width adjustment mechanism is further preferably provided for selectively adjusting the relative spacing between the inner runs of the first and second digitated conveyor belts on respective opposite sides of the base conveyor. In a presently preferred embodiment, the base conveyor comprises a pair of laterally spaced conveyor belts to facilitate manual loading of the apparatus with stacks of the flexible bags.

During operation of the present apparatus, flexible bags are retained and advanced in a substantially fully extended, generally vertical orientation. Bags are advanced by independently, intermittently operating the base conveyor, and the first and second digitated belts, with the apparatus configured to transport individual ones of the flexible bags, or groups or pluralities of the bags. Sensors are provided for monitoring the orientation of the forward-most bag in the apparatus, with independent operation of the conveyors acting to maintain the forward-most bag in the desired substantially vertical orientation.

Other features and advantages of the present invention will become readily apparent from the following detailed description, the accompanying drawings, and the appended claims.

DETAILED DESCRIPTION

Figure 1:
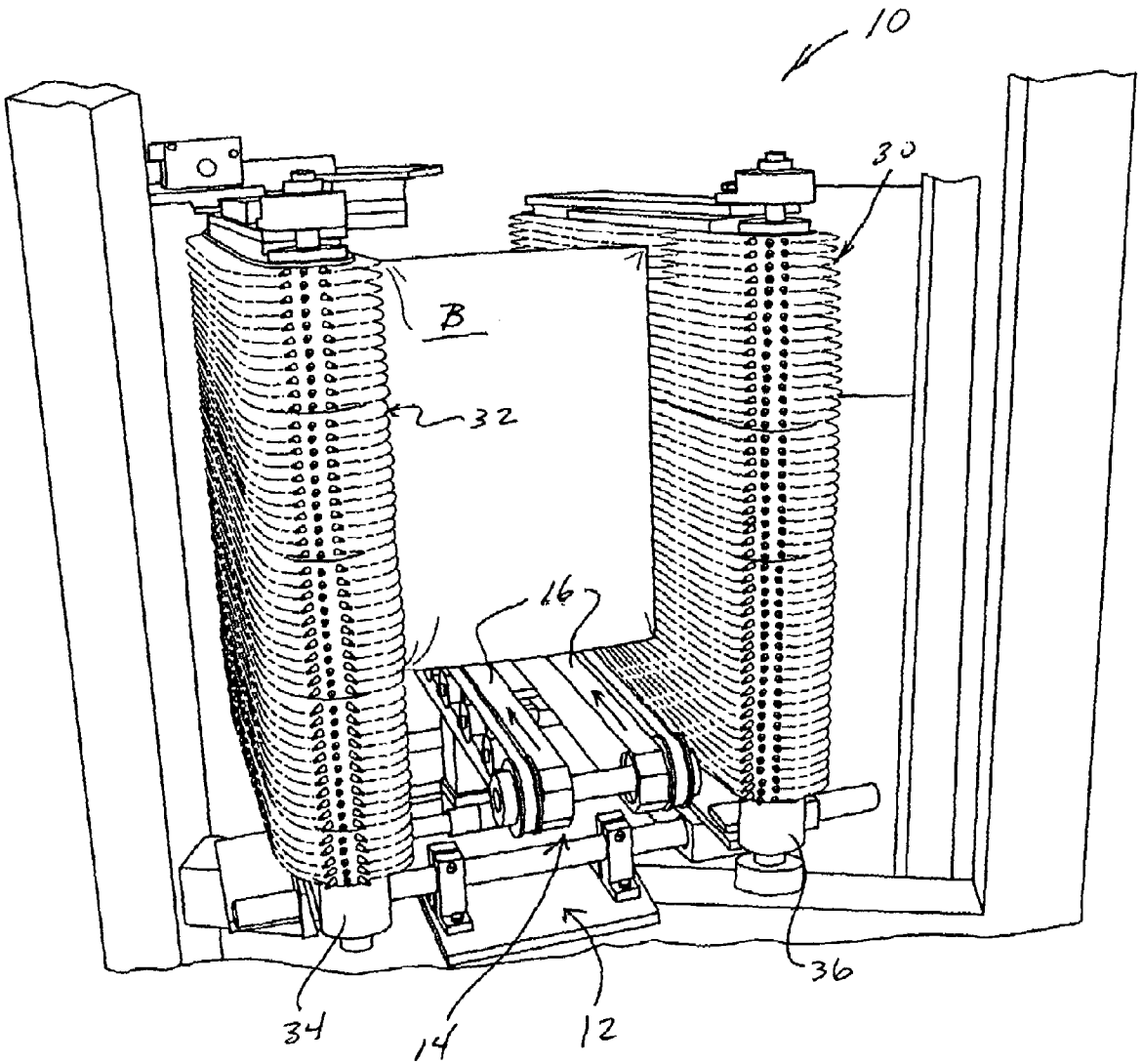
FIG. 1 is a perspective view of an apparatus for transporting flexible bags embodying the principles of the present invention, taken from the loading end of the apparatus.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

Referring first to FIG. 1, therein is illustrated a powered magazine apparatus 10 for retaining and advancing flexible bags embodying the principles of the present invention. As will be further described, apparatus 10 includes a system of indexing conveyors, independently intermittently operable, for receiving, retaining, and transporting flexible bags, while the bags are maintained in a generally fully extended vertical orientation. By this arrangement, a large plurality of bags can be retained, horizontally transported, and presented in a substantially vertical orientation for subsequent filling. Notably, the present magazine apparatus can handle and transport individual ones of the flexible bags, or groups or pluralities of the bags. It is particularly desirable that the present apparatus can efficiently handle bottom-gussetted flexible bags, or other bags which may include a special feature at one end, which bags are ordinarily thicker at one end portion than at the other.

In accordance with the illustrated embodiment, the apparatus 10 includes a base frame 12 which carries a base indexing conveyor 14. Base conveyor 14 preferably comprise a pair of laterally spaced conveyor belts 16, with each of the flexible bags, designated B, positioned to be supported, and intermittently transported along, the base conveyor 14. By providing base conveyor 14 with a pair of belts 16, clearance is provided between the belts to permit an operator to manually load a stack of bags, while they are held substantially vertically. The spacing provides clearance for the hand of the operator which grasps the lower edge of the stacked bags as they are loaded into the apparatus.

Figure 2:
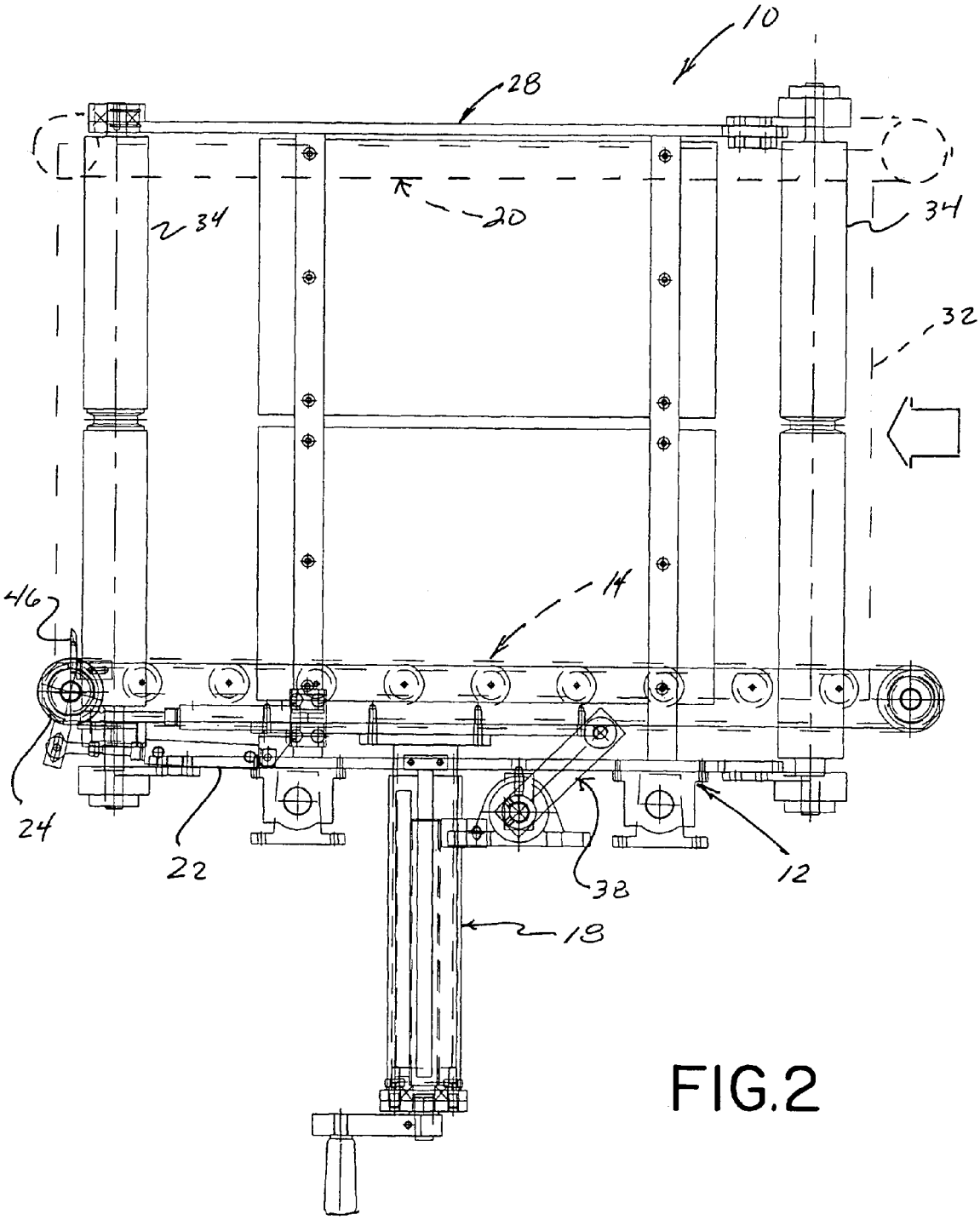
FIG. 2 is a diagrammatic, side elevational view of the present apparatus.

In order to facilitate retention and transport of flexible bags of varying dimensions, apparatus 10 preferably includes an adjustment mechanism 18 (FIG. 2) for selectively vertically adjusting the position of base conveyor 14. The adjustment mechanism may include suitable screw ramps or the like, whereby the vertical position of the base conveyor 14 can be selectively adjusted. By this arrangement, the base indexing conveyor can be moved relative to an upper datum line that represents the desired location for the top edge of the bag, irrespective of bag height. In a current embodiment, apparatus 10 can accommodate bags which vary from 11 inches to 22 inches in height.

For some applications, it can be desirable to provide apparatus 10 with an upper indexing conveyor 20 for retaining upper edges of bags B. This can be desirable for handling of relatively large bags which may exhibit a high degree of flexibility, and relatively little rigidity.

Intermittent, indexed advancement and operation of base conveyor 14 is preferably effected by the provision of pneumatic motor 22, which operates through a one-way clutch assembly 24 for effecting indexed advancement of the base conveyor when the piston of the motor retracts. As will be recognized by those familiar with the art, other suitable drive arrangements can be employed, such as servo motors or the like.

The one-way clutch assembly 24 preferably includes a pair of cooperating one-way clutches. One of the clutches permits reverse motion of the associated pneumatic motor 22 without movement of the associated conveyor. The other one-way clutch prevents movement of the associated conveyor from forces resulting from removal or "picking" of the forward-most one of the bags from the magazine apparatus.

As noted, flexible bags to be transported are each generally supported at the lower extent thereof by the base conveyor, and are advanced therealong by intermittent operation of pneumatic motor 22, which acts to intermittently advance the base conveyor belts 16. In accordance with the present invention, opposite marginal edges of each flexible bag are supported, generally throughout their vertical extent, by a pair of vertically-oriented indexing conveyors, as will now be described.

Apparatus 10 includes first and second, generally vertically oriented side frames 26, 28, positioned on respective opposite sides of the base conveyor 14. The side frames respectively carry first and second digitated conveyor belts 30, 32, which are respectively trained about conveyor rollers 34, 36 carried by each of the side frames for rotation about respective vertical axes.

Notably, the digitated belts 30, 32 each comprise a large multiplicity of outwardly projecting fingers, which are horizontally and vertically spaced from each other. In the preferred form, as illustrated, the outwardly projecting fingers of each digitated belt are arranged in vertically aligned rows. Each finger of the digitated belts are generally conic in configuration, including a relatively thin, generally cylindrical projection at the outward extent thereof, with each finger preferably extending in normal relationship to the belt surface.

As illustrated, each of the digitated belts 30, 32 defines an inner run along which the fingers of each of the belts extend inwardly toward the base conveyor 14. The inner runs of the digitated belts are thus arranged in confronting relationship on respective opposite sides of base conveyor 14. By this arrangement, each of the flexible bags B to be retained and conveyed is supported at its lower extent by the base conveyor 14, with opposite marginal edges of each bag supported substantially through the vertical extent thereof by the projecting fingers of each of the first and second digitated belts 30, 32.

Figure 3:
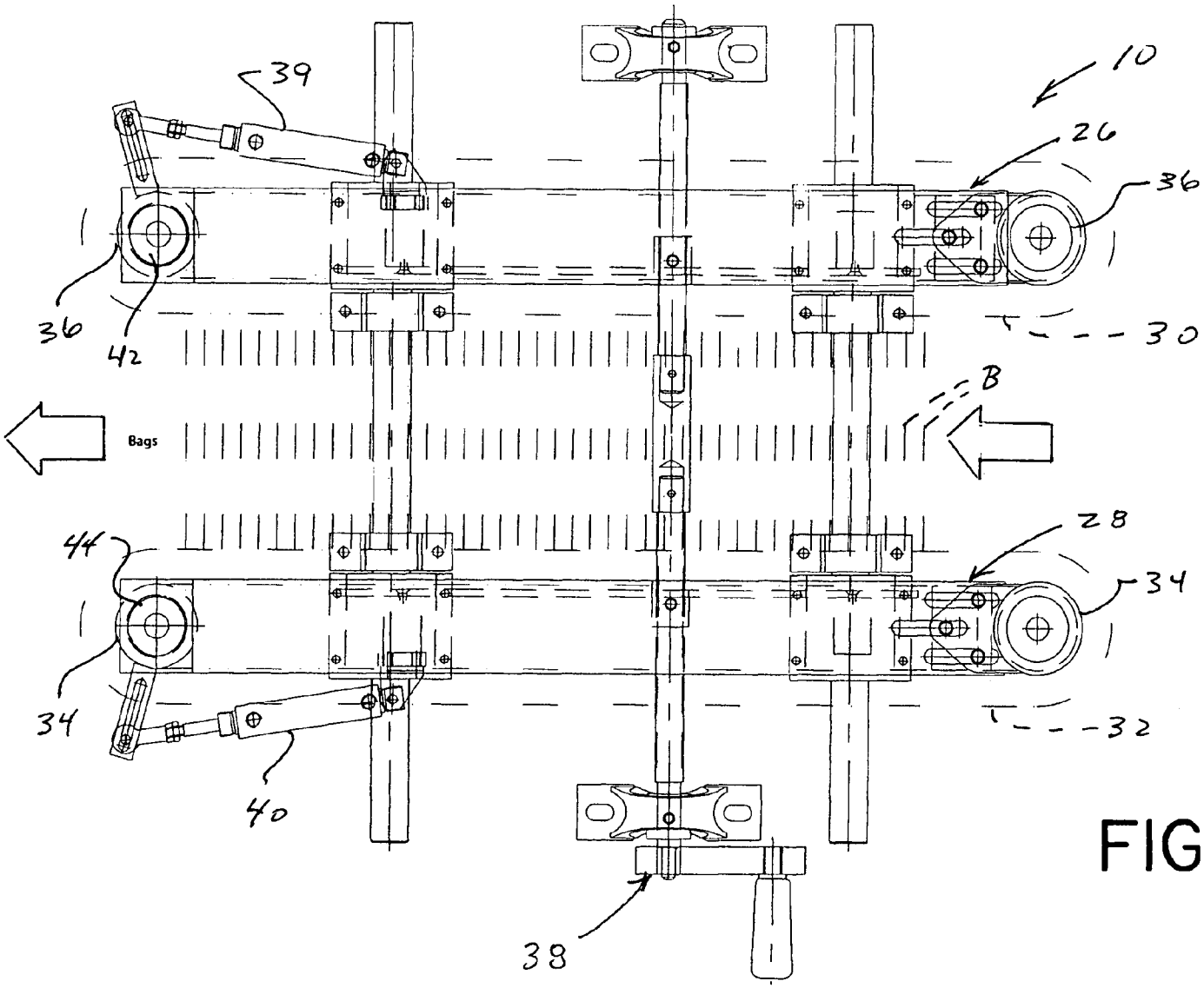
FIG. 3 is a diagrammatic, top plan view further illustrating the present apparatus.

Digitated belts 30, 32 are preferably formed from suitable elastomeric material, whereby the belts are suitably flexible for guided movement about rollers 34, 36, with formation from such elastomeric material facilitating cleaning of the belts, as may be required for certain packaging environments. The elastomeric nature of each of the digitated belts has been found to desirably provide very efficient retention and gripping cooperation with the opposite marginal edges of each bag being retained and transported within the present apparatus. Retention of each bag substantially throughout its vertical extent has been found to desirably act to maintain each bag in a substantially fully extended, upright orientation, thereby effecting the desired presentation of each bag, at the discharge end of the magazine apparatus 10 (at the left-hand end, referring to the orientation of FIG. 3), for subsequent sequential removal from the apparatus, and filling by an associated filling apparatus.

In order to further accommodate bags of varying dimensions, apparatus 10 includes a width adjusting mechanism 38 for selectively adjusting the relative spacing between the inner runs of the first and second digitated conveyor belts 30, 32 on respective opposite sides of base conveyor 14. The adjustment mechanism may suitably comprise oppositely threaded screw thread arrangements, whereby operation of the mechanism acts to simultaneously move first and second side frames 26, 28 toward and away from each other, while the inner runs of the first and second digitated belts 30, 32 are maintained in parallel relationship to each other on respective opposite sides of base conveyor 14.

The present apparatus can be economically employed for retention and transport of flexible bags, in that first and second digitated belts 30, 32 can be efficiently fabricated from generally commercially available belt material which finds utility in connection with poultry processing for plucking or removing feathers from poultry carcasses.

Intermittent advancement of first and second digitated conveyor belts 30, 32 is preferably effected via suitable conveyor drives, including respective pneumatic motors 39, 40, which operate through respective one-way clutch assemblies 42, 44, like clutch assembly 24 described above. Again, other suitable drive arrangements can be employed for intermittent operation of the digitated belts with each other, and with base conveyor 14. During operation, individual ones, or groups, of bags B are presented generally at a discharge end of the apparatus 10. An associated removal device, typically comprising a suitable suction mechanism, removes each bag from the apparatus, while the bag is maintained in a generally upright, fully extended orientation for subsequent filling.

To promote efficient removal of the forward-most one of the bags from the present magazine apparatus when it has advanced to centrally positioned end stop 46 (FIG. 2), it is desirable that this bag be presented in a substantially vertical orientation. To this end, the apparatus includes suitable position sensors for monitoring the orientation of the forward-most bag. Independent intermittent operation of base conveyor 14, and digitated belts 30, 32, responsive to the position sensors, desirably function to maintain the forward-most bag in a substantially vertical orientation. This is a particularly desirable feature of the present apparatus in view of its contemplated use for handling bottom-gussetted bags, which are typically thicker at their bottom portions than at the tops thereof, or other bag features which could affect stack thickness.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A magazine apparatus for retaining flexible bags, comprising:

a base frame;

a base conveyor carried by said base frame;

first and second, generally vertically oriented side frames positioned on respective opposite sides of said base conveyor; and first and second digitated conveyor belts respectively carried by said first and second side frames, each of said digitated belts comprising a large multiplicity of outwardly projecting, generally conic fingers spaced horizontally and vertically from each other, each of the digitated belts defining an inner run along which the fingers of each of said digitated belts extend inwardly toward said base conveyor, so that each said flexible bag is conveyed while supported at its lower extent by said base conveyor, with opposite marginal edges of each said bag supported substantially throughout the vertical extent thereof by the projecting fingers of said first and second digitated belts.

2. A magazine apparatus for retaining flexible bags in accordance with claim 1, including:

a width adjustment mechanism for selectively adjusting the relative spacing between said inner funs of said first and second digitated conveyor belts on respective opposite sides of said base conveyor.

3. A magazine apparatus for retaining flexible bags in accordance with claim 1, wherein;

said base conveyor comprises a pair of laterally spaced base conveyor belts.

4. A magazine apparatus in accordance with claim 1, including a plurality of conveyor drives for independently driving said base conveyor, and each of said first and second digitated conveyor-belts.

5. A magazine apparatus for retaining flexible bags comprising:

a base frame;

a base conveyor carried by said base frame;

first and second, generally vertically oriented side frames positioned on respective opposite sides of said base conveyor; and first and second digitated conveyor belts respectively carried by said first and second side frames, each of said digitated belts comprising a large multiplicity of outwardly projecting fingers spaced horizontally and vertically from each other, each of the digitated belts defining an inner run along which the fingers of each of said digitated belts extend inwardly toward said base conveyor, so that each said flexible bag is conveyed while supported at its lower extent by said base conveyor, with opposite marginal edges of each said bag supported substantially throughout the vertical extent thereof by the projecting fingers of said first and second digitated belts, wherein said outwardly projecting fingers of each of said digitated belts are arranged in vertically aligned rows.

6. A magazine apparatus for retaining flexible bags comprising:

a base conveyor carried by said base frame;

first and second, generally vertically oriented side frames positioned on respective opposite sides of said base conveyor; and first and second digitated conveyor belts respectively carried by said first and second side frames, each of said digitated belts comprising a large multiplicity of outwardly projecting fingers spaced horizontally and vertically from each other, each of the digitated belts defining an inner run along which the fingers of each of said digitated belts extend inwardly toward said base conveyor, so that each said flexible bag is conveyed while supported at its lower extent by said base conveyor, with opposite marginal edges of each said bag supported substantially throughout the vertical extent thereof by the projecting fingers of said first and second digitated belts, including a vertical adjustment mechanism for selectively vertically adjusting the position of said base conveyor belt between said first and second digitated conveyor belts.

7. A magazine apparatus for retaining flexible bags comprising:

a base conveyor carried by said base frame;

first and second, generally vertically oriented side frames positioned on respective opposite sides of said base conveyor;

first and second digitated conveyor belts respectively carried by said first and second side frames, each of said digitated belts comprising a large multiplicity of outwardly projecting fingers spaced horizontally and vertically from each other, each of the digitated belts defining an inner run along which the fingers of each of said digitated belts extend inwardly toward said base conveyor, so that each said flexible bag is conveyed while supported at its lower extent by said base conveyor, with opposite marginal edges of each said bag supported substantially throughout the vertical extent thereof by the projecting fingers of said first and second digitated belts, and a plurality of conveyor drives for independently driving said base conveyor, and each of said first and second digitated conveyor belts, wherein each of said conveyor drives includes a one-way clutch assembly comprising a pair of one-way clutches, and an associated pneumatic motor, one of said clutches permitting reverse motion of the associated pneumatic motor without movement of the associated conveyor, the other of said clutches preventing movement of the associated conveyor during removal of a forward-most one of said bags from said apparatus.

8. A magazine apparatus for retaining flexible bags, comprising:

a base conveyor carried by said base frame;

first and second, generally vertically oriented side frames positioned on respective opposite sides of said base conveyor; and first and second digitated conveyor belts respectively carried by said first and second side frames, each of said digitated belts comprising a large multiplicity of outwardly projecting fingers spaced horizontally and vertically from each other, each of the digitated belts defining an inner run along which the fingers of each of said digitated belts extend inwardly toward said base conveyor, so that each said flexible bag is conveyed while supported at its lower extent by said base conveyor, with opposite marginal edges of each said bag supported substantially throughout the vertical extent thereof by the projecting fingers of said first and second digitated belts, and an upper conveyor positioned in spaced relationship above said base conveyor for retaining upper edges of said flexible bags.

9. A method of retaining flexible bags, comprising the steps of:

providing a base conveyor;

providing first and second digitated conveyor belts positioned on respective opposite sides of said base conveyor, wherein each of said digitated belts comprises a large multiplicity of outwardly projecting, generally conic fingers spaced horizontally and vertically from each other; and retaining said flexible bags in a generally vertical orientation, with the lower extent of each said bag supported by said base conveyor, with opposite marginal edges of each said bag supported substantially through the vertical extent thereof by the projecting fingers of said first and second digitated conveyor belts.

10. A method of retaining flexible bags in accordance with claim 9, wherein:

said base conveyor and said first and second digitated belts are independently, intermittently operated for advancing said flexible bags and maintaining a forward-most one of said bags in a substantially vertical orientation.

11. A method of retaining flexible bags comprising the steps of:

providing a base conveyor;

providing first and second digitated conveyor belts positioned on respective opposite sides of said base conveyor, wherein each of said digitated belts comprises a large multiplicity of outwardly projecting, generally conic fingers spaced horizontally and vertically from each other; and retaining said flexible bags in a generally vertical orientation, with the lower extent of each said bag supported by said base conveyor, with opposite marginal edges of each said bag supported substantially through the vertical extent thereof by the projecting fingers of said first and second digitated conveyor belts, and providing an upper conveyor, and retaining upper edge portions of said flexible bags.

* * * * *